US011389709B2

(12) United States Patent
Spartz

(10) Patent No.: US 11,389,709 B2
(45) Date of Patent: Jul. 19, 2022

(54) TRAINING APPARATUS FOR SHOOTING BASKETBALL

(71) Applicant: Christopher Spartz, Western Springs, IL (US)

(72) Inventor: Christopher Spartz, Western Springs, IL (US)

(73) Assignee: SPARTZ SPORTZ LLC, Western Springs, IL (US)

( * ) Notice: Subject to any disclaimer, the term of this patent is extended or adjusted under 35 U.S.C. 154(b) by 6 days.

(21) Appl. No.: 16/521,478

(22) Filed: Jul. 24, 2019

(65) Prior Publication Data

US 2021/0023429 A1 Jan. 28, 2021

(51) Int. Cl.
*A63B 69/00* (2006.01)
*A63B 71/06* (2006.01)

(52) U.S. Cl.
CPC ..... *A63B 69/0071* (2013.01); *A63B 69/0059* (2013.01); *A63B 71/0619* (2013.01); *A63B 2071/0655* (2013.01); *A63B 2209/00* (2013.01); *A63B 2225/09* (2013.01)

(58) Field of Classification Search
CPC ..... A63B 69/0071; A63B 69/0059; A63B 71/0619; A63B 2225/09; A63B 2071/0655; A63B 2209/00
See application file for complete search history.

(56) References Cited

U.S. PATENT DOCUMENTS

| | | | | |
|---|---|---|---|---|
| 5,005,833 A | | 4/1991 | Groveman | |
| 5,938,548 A | * | 8/1999 | Upshaw | A63B 69/0059 473/453 |
| 6,196,931 B1 | * | 3/2001 | Wilt | A63B 69/3608 473/212 |
| 8,968,121 B2 | * | 3/2015 | Leggett | A63B 69/0002 473/422 |
| 9,687,716 B2 | | 6/2017 | George | |
| 2012/0190483 A1 | * | 7/2012 | Grover | A63B 69/0071 473/422 |
| 2014/0315666 A1 | * | 10/2014 | Medley | A63B 21/4017 473/450 |

* cited by examiner

*Primary Examiner* — Jeffrey S Vanderveen

(74) *Attorney, Agent, or Firm* — Neal, Gerber & Eisenberg LLP

(57) ABSTRACT

A training apparatus for assisting a person shooting a basketball includes a first wearable member for being equipped on a person's arm, a loop for slidably fitting on the person's other arm, and a bridge for connecting the first wearable member and the loop. The bridge provides feedback to the person while a shooting motion is being executed, thereby promoting consistency in the person's shooting form.

12 Claims, 8 Drawing Sheets

TRAINING APPARATUS FOR SHOOTING BASKETBALL

TECHNICAL FIELD

The present disclosure generally relates to a training apparatus for shooting a basketball and, more specifically, a wearable training apparatus for providing constant feedback while shooting a basketball.

BACKGROUND

In basketball, long range shots, such as a three-point field goal, are critical for winning a game. For many basketball players, improving field goal percentage is a daunting task, which requires many hours of dedication and practice. Further, in order to improve field goal percentage, players need to execute a consistent shooting motion. Therefore, there is a need for a training device that improves a player's shot by providing consistent feedback.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example training apparatus and method for assisting a person shooting a basketball are described herein. The training apparatus includes a first wearable member for being equipped on a person's arm, a loop for slidably fitting on the person's other arm, and a bridge for connecting the first wearable member and the loop.

The method includes equipping a first wearable member on a person's arm, slidably fitting a loop on the person's other arm, the loop being connected to the first wearable member via a bridge, adjusting a length of the bridge, and adjusting the positon of person's arms based on tension applied on the bridge.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1A:
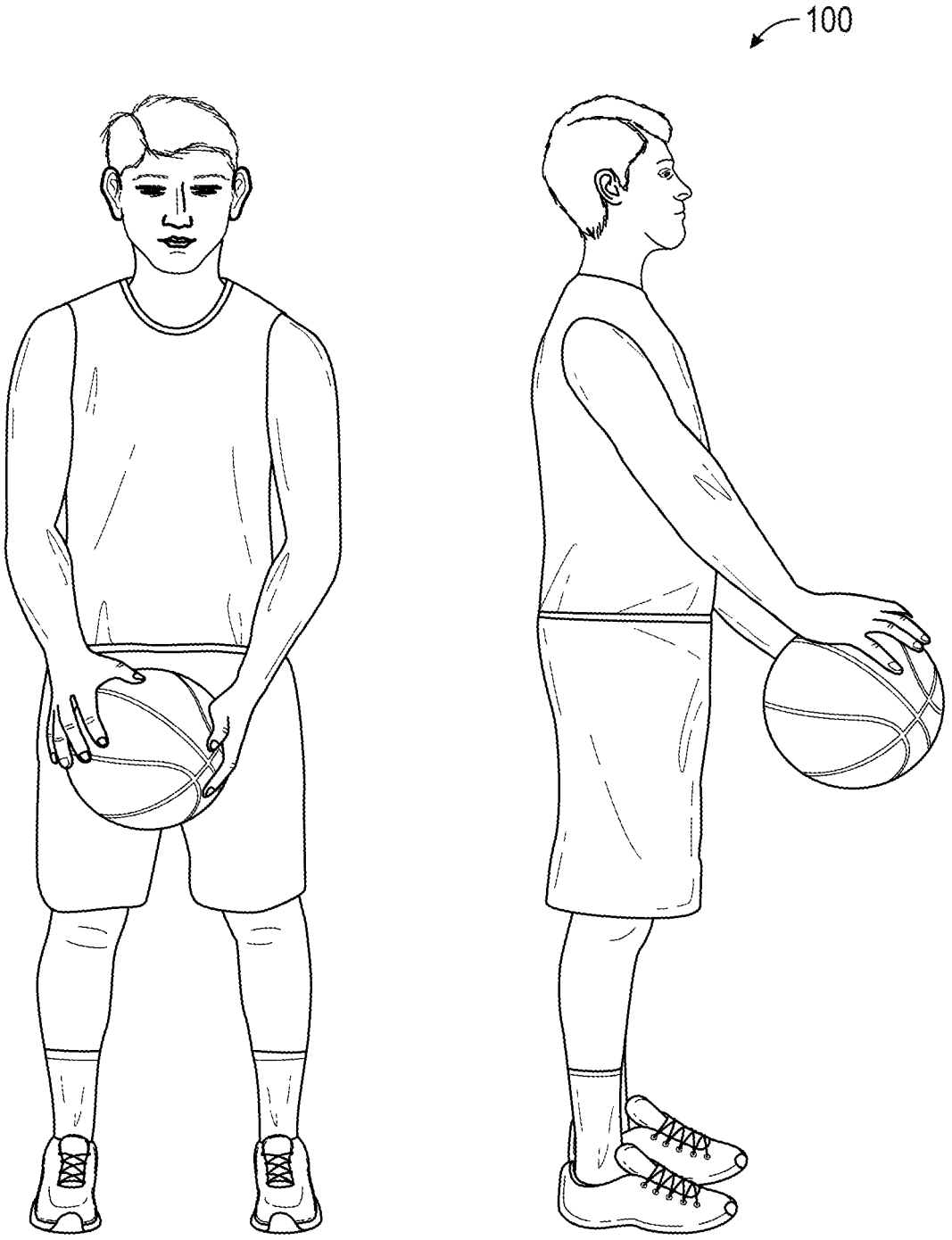
FIGS. 1A-1C illustrate an example scenario in which a person executes example motions for shooting a basketball.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

In basketball, long range shots are essential for winning games. From 1980 to 2019, the average 3-point shot attempts per National Basketball Association (NBA) game have increased from approximately 2.8 to 30.7, thereby signifying the importance long range shots at professional levels. Statistics show that those among the professional basketball players having high field goal percentage generally follow a three-step shooting motion to execute a successful shot.

Figure 1B:
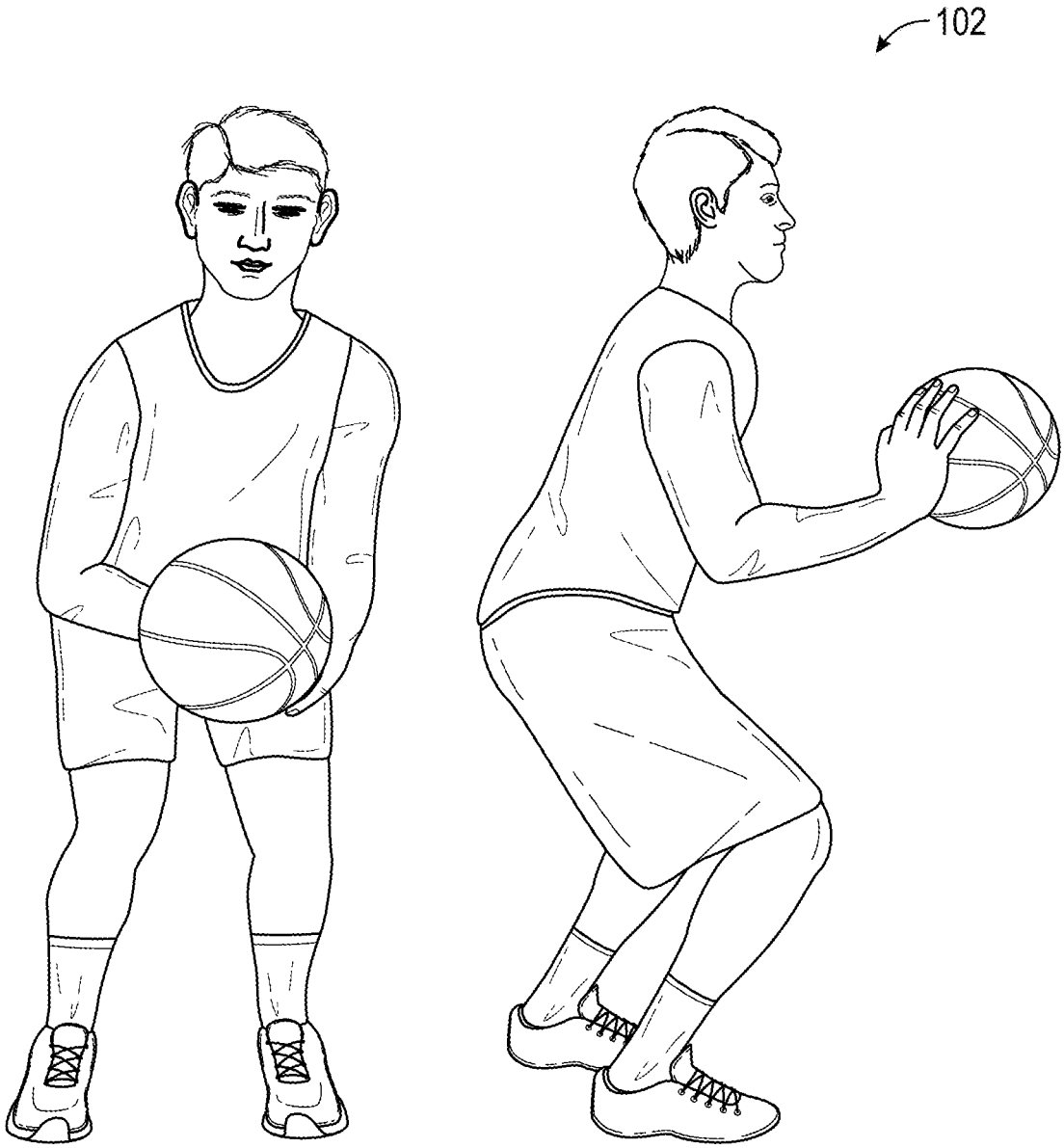
Figure 1C:
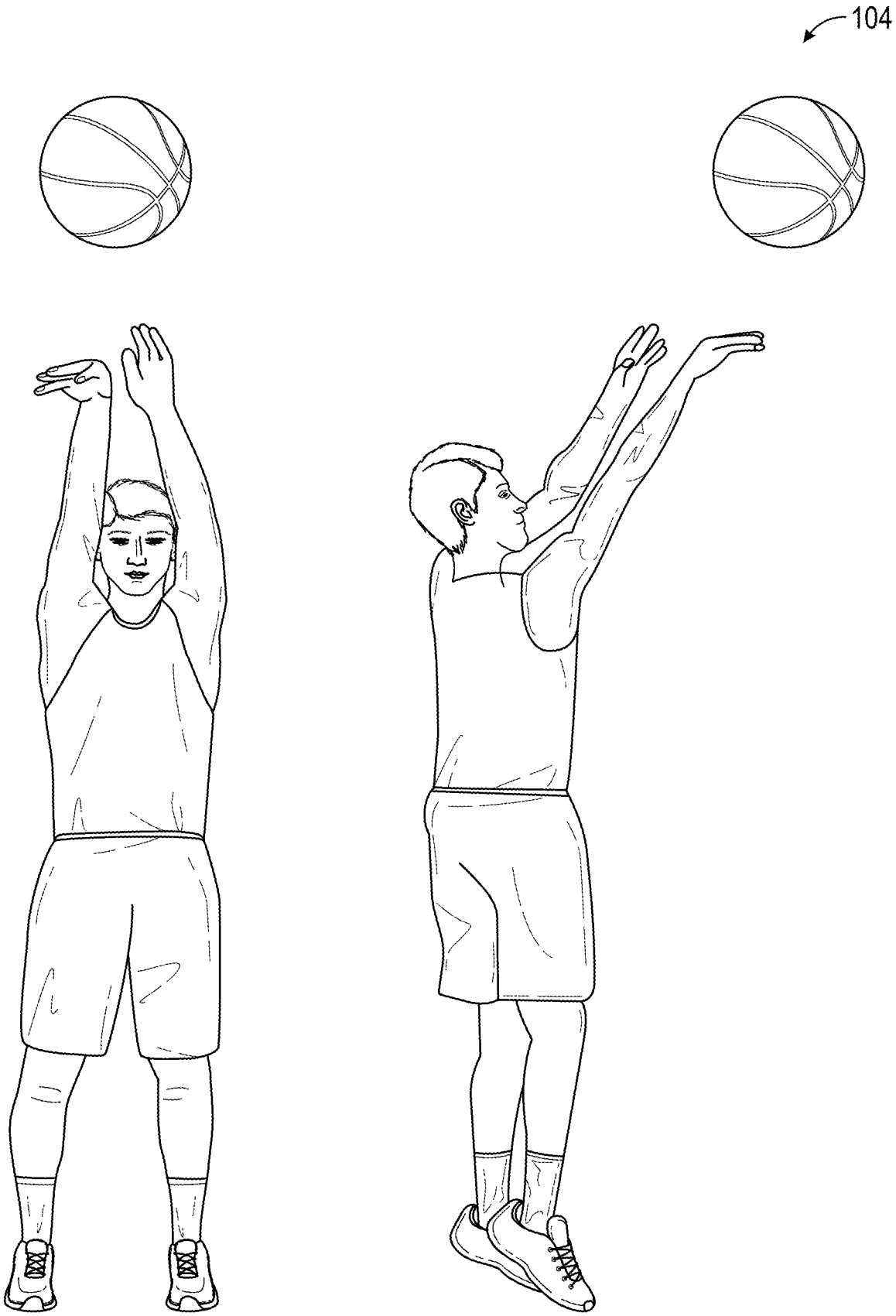

FIGS. 1A-1C illustrate an example scenario in which a person executes example motions for shooting a basketball. In the illustrated examples, these motions demonstrate the three-step shooting motion. Each of FIGS. 1A-1C illustrate a front view and a side view.

FIG. 1A illustrates the first posture 100 of the motion. In this illustrated example, the person squares his shoulders to align with the rim such that the shoulders are generally perpendicular to the radius of the rim. The person holds the basketball while having his arms down or completely down. The upper arms are parallel or substantially parallel to each other and are slightly in front of the torso. The ball is placed in front of the person. The guide hand is placed on a side of the ball relative to the person, and the shooting hand is placed slightly on another side such that the shooting hand is positioned closer to the center of the ball than the guide hand.

FIG. 1B illustrates the second subsequent posture 102 of the motion. In the illustrated example, the person moves his shoulder over his toes and bends his knees and hips while remaining squared with the rim. The elbows stay in front and bends as the ball is being raised. The elbows are connected to and in front of the torso. The person positons the ball such that it is positioned below the sternum. The upper arms are maintained parallel or substantially parallel.

FIG. 1C illustrates the third subsequent posture 104 of the motion. In the illustrated example, the person moves up vertically while releasing the shooting hand/arm. The guide hand maintains contact with the ball until the ball releases. The upper arms are maintained parallel or substantially parallel. The shoulders remain square with the rim when the ball is released. While the ball is being released, the person leans on his toes and pushes himself up.

In this three-step shooting motion, it is critical that the upper arms remain parallel or substantially parallel to each other. This posture allows the players to release the ball vertically, thus ensuring improved accuracy of the shot. While this strategy is taught to many amateur basketball players, it requires constant observation and feedback from coaches. Further, in order for this motion to be effective at competitive levels, the amount of time for releasing the ball must be minimized. Perfecting the three-step shooting motion not only requires time but correct training that produces the same postures each time the shooting motion is executed. Therefore, there is a need in the art for training long range shots with constant feedback.

Figure 2:
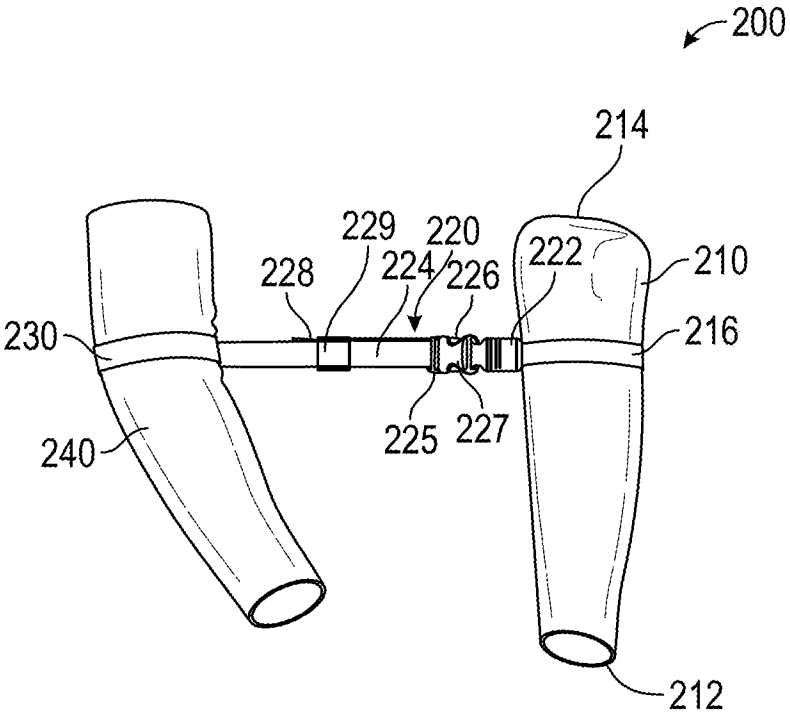
FIG. 2 illustrates a training apparatus in accordance with this disclosure.

FIG. 2 illustrates a training apparatus 200 in accordance with this disclosure. The training apparatus 200 comprises a first wearable member 210, a bridge 220, and a loop 230.

The first wearable member 210 may be a shooting sleeve. The first wearable member 210 may be shaped or roughly shaped as a cylinder. The first wearable member 210 may be worn by a user such that is covers the arm, completely or partially, from the wrist to the upper region of the arm that is proximate to the armpit/shoulder. The first wearable member 210 may be formed of an elastic material, completely or partially, such as a spandex or a blend of spandex and nylon. The first wearable member 210 defines a first opening 212 at one end thereof and a second opening 214 at the other end thereof. In certain embodiments, portions of the first wearable member 210 surrounding the first opening 212 and the second opening 214 may be reinforced with additional material and/or layer, providing thickness to ensure durability of the first wearable member 210. In certain embodiments, one or more inner surfaces of the first wearable member 210 may be lined with a non-slip fabric/material such that the first wearable member 210 maintains frictional connection with the arm even when the arm is exposed to moist environment (e.g., sweat, water, etc.). In certain embodiments, the first wearable member 210 may be shaped such that one end of the first wearable member 210 has a first width and one or more subsequent portions of the first wearable member 210 along the direction in which the first wearable member 210 extends (referred herein as longitudinal direction) have a width greater than the first width, such that first wearable member 210 is generally formed as a shape of a person's arm, thereby uniformly providing elasticity and flexibility throughout various regions of the person's arm and ensuring a comfortable fit. The first wearable member 210 includes a connection loop 216. The connection loop 216 is formed to loop 230 around the first wearable member 210. The connection loop 216 is defined in one half of the first wearable member 210 and proximate to the center of the first wearable member 210. As such, when the first wearable member 210 is equipped on a person's arm, the connection loop 216 is positioned on the upper arm proximate to the person's elbow. In certain embodiments, the connection loop 216 may be reinforced with additional material(s) and/or layer(s). Said material and/or layer may be formed of the same material as the first wearable member 210 or different material having different elasticity and/or flexibility. In certain embodiments, the connection loop 216 may be connected to the first wearable member 210 via stitching.

The bridge 220 connects the first wearable member 210 and the loop 230. The bridge 220 may be formed of an elastic material, completely or partially, such as a spandex or a blend of spandex and nylon. In certain embodiments, the bridge 220 includes a first strap 222 and a second strap 224. In such embodiments, one end of the first strap 222 is connected to the first wearable member 210, specifically, said end is connected to the connection loop 216. The bridge 220 may be connected to the connection loop 216 via stitching, thereby enhancing durability of the connection between the bridge 220 and the first wearable member 210. Further, since the bridge 220 is connected to the connection loop 216, when the bridge 220 is stretched, one or more portions of the first wearable member 210 having less reinforcement than the connection loop 216 (e.g., portions of the first wearable member 210 that are proximate to the connection loop 216) is minimally stretched, thereby improving the durability of the first wearable member 210. The other end of the first strap 222 may include a first male/female clip 226 that is connectable to its counterpart. One end of the second strap 224 includes a second male/female clip 227 connectable to the first clip 226 (i.e., the counterpart of the first clip 226). In the illustrated example, the first clip 226 and the second clip 227 are a side release buckle, however, it should be appreciated that the first clip 226 and the second clip 227 may alternatively be different type of clips, such as an adjustable band clip, a shielded side release buckle, etc. The first clip 226 or the second clip 227 may include a first adjustable element 225. The first adjustable element 225 may be a strap adjuster. The first adjustable element 225 may be used to adjust the length of the bridge 220, thereby adjusting the tension between the loop 230 and the first wearable member 210. In the illustrated embodiment, the first adjustable element is integrally connected to the second clip 227. In certain embodiments, an end of the first strap 222 or the second strap 224 may include a tail 228. In the illustrated embodiment, the end of the second strap 224 includes the tail 228. The tail 228 may be pulled in a certain direction with respect to the first or second clip such that the length of the bridge 220 is adjusted. For example, the tail may be pulled in a direction parallel to a direction in which the first adjustable element 225 and the second clip 227 are connected, thereby reducing the length of the bridge 220. In such example, the second strap 224 may be pulled in the same direction while the first adjustable element 225 and the second clip 227 are angled with respect to said direction, thereby increasing the length of the bridge 220. The end of the tail 228 may be reinforced with additional material and/or layer to limit the degree of the length at which the bridge 220 is increased. The tail 228 includes a strap loop 229 for slidably connecting to the first strap 222 or the second strap 224. The strap loop 229 functions to limit the degree in which the length of the bridge 220 is adjusted and prevent the tail 228 from flailing while the training apparatus 200 is in use. In the illustrated example, the strap loop 229 is slidably connected to the second strap 224. In certain embodiments, the first strap 222 or the second strap 224 may be shorter than the other such that the length at which the strap loop 229 is slidable on the first strap 222 or the second strap 224 is maximized. For example, in the illustrated embodiment, since the strap loop 229 is slidably connected to the second strap 224, the second strap 224 is longer than the first strap 222 to maximize the length at which the strap loop 229 is slidable on the second strap 224.

The loop 230 is connected to the other end of the second strap 224. The loop 230 may be formed of an elastic material, completely or partially, such as a spandex or a blend of spandex and nylon. The loop 230 may be integrally connected to the other end of the second portion. The loop 230 may be slidably fitted on a person's arm. The size of the loop 230 may correspond to a size of a person's arm, particularly, regions defined by the person's bicep/upper elbow. In certain embodiments, the loop 230 may include a second adjustable element (not illustrated) for adjusting the size of the loop 230. For example, the second adjustable element may be a strap adjuster. The loop 230 may be formed of same material and construction of the connection loop 216. In certain examples, the loop 230 may be designed to have the same or substantially the same flexibility and or elasticity as the connection loop 216.

As mentioned above, the connection loop 216 may be reinforced with additional material(s) and/or layer(s). Further, regions of the first wearable member 210 other than the connection loop 216 may be thinner than the connection loop 216. This ensures that the first wearable member 210 maximizes breathability and comfort while providing durable connection between the bridge 220 and the connection loop 216.

In certain embodiments, the training apparatus 200 may further include a second wearable member 240. The second wearable may be a shooting sleeve. The second wearable may be the same or substantially the same as the first wearable member 210. Therefore, detail 228*s* thereof will not be described herein for brevity. The loop 230 may be slidably inserted into the second wearable member 240. In certain embodiments, the second wearable member 240 and the loop 230 may be formed of material having low friction, thereby guaranteeing a certain degree of freedom of movement between the second wearable member 240 and the loop 230 when a shooting motion is executed. The second wearable member 240 may be a generic shooting sleeve.

Figure 3:
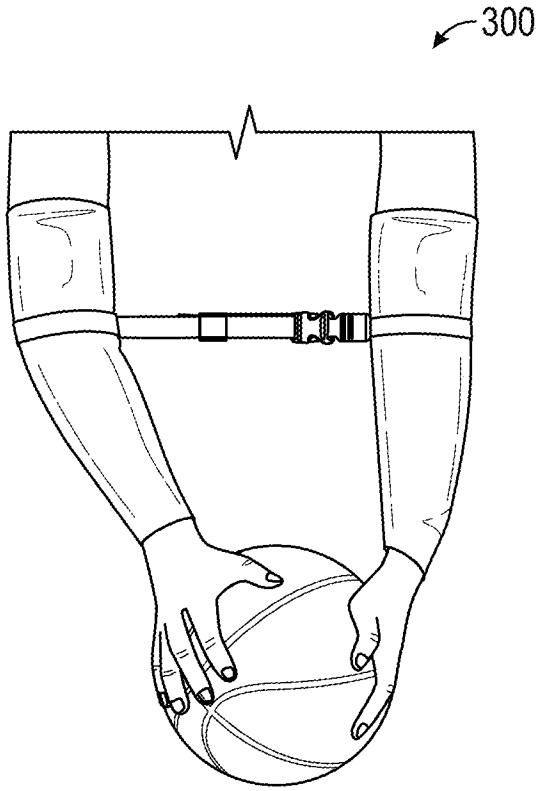
FIG. 3 illustrates a preferred embodiment in which the training apparatus of FIG. 2 is utilized.

FIG. 3 illustrates a preferred embodiment in which the training apparatus 200 of FIG. 2 is utilized. Preferably, the first wearable member 210 is equipped on a person's shooting arm to cover the arm from the wrist to the upper arm region. The first wearable member 210 is oriented on the arm such that a point of connection between the bridge 220 and the first wearable member 210 (herein referred as connection point) generally faces inwards towards the guide arm. Preferably, the connection point is positioned over a portion of the upper arm that is at or proximate to the inner elbow. The loop 230 may be wrapped around on the guide arm at the same or substantially the same vertical height at which the connection point is positioned on the shooting arm, thereby flexibly connecting the shooting arm and the guide arm from elbow-to-elbow. The first adjustable element 225 may be adjusted such that the length of the bridge 220 corresponds to a width of the person's chest. The first adjustable element 225 may be adjusted such that when the upper arms of the person are parallel to each other, the bridge 220 is perpendicular or substantially perpendicular to both of the person's arms.

Figure 4A:
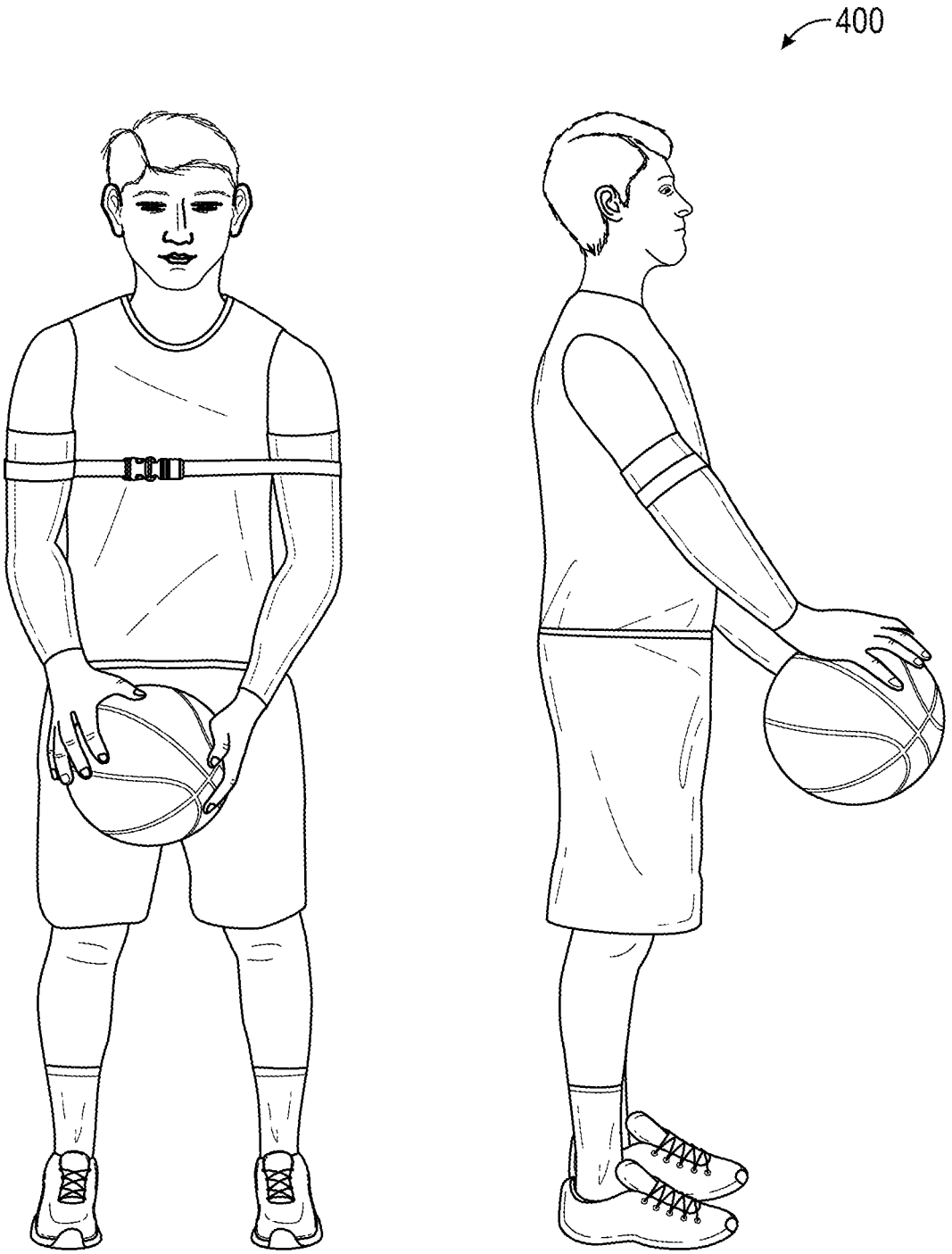
FIGS. 4A-4C illustrate example scenarios in which a person utilizes the training apparatus of FIG. 2 and executes example motions for shooting a basketball.
Figure 4B:
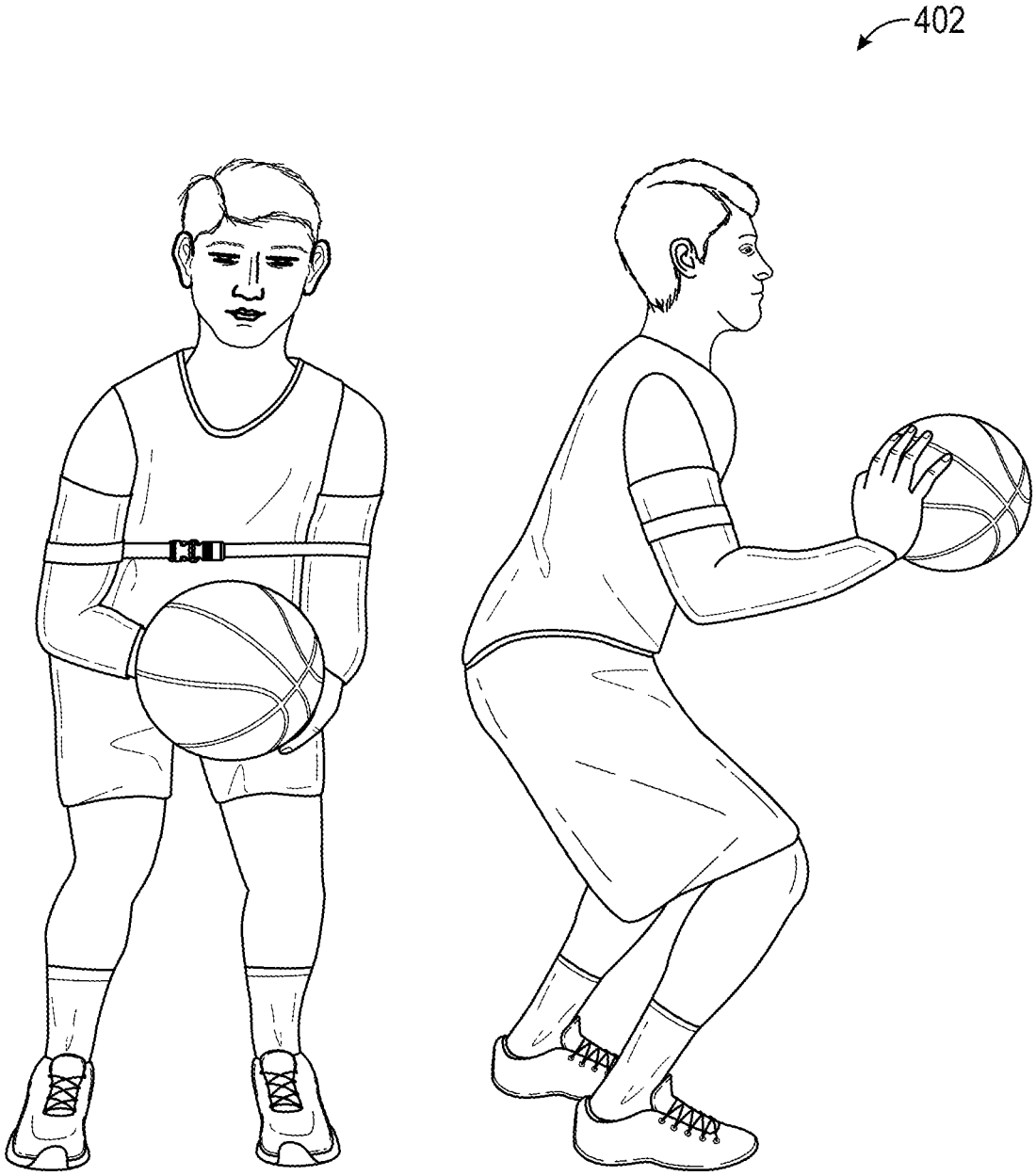
Figure 4C:
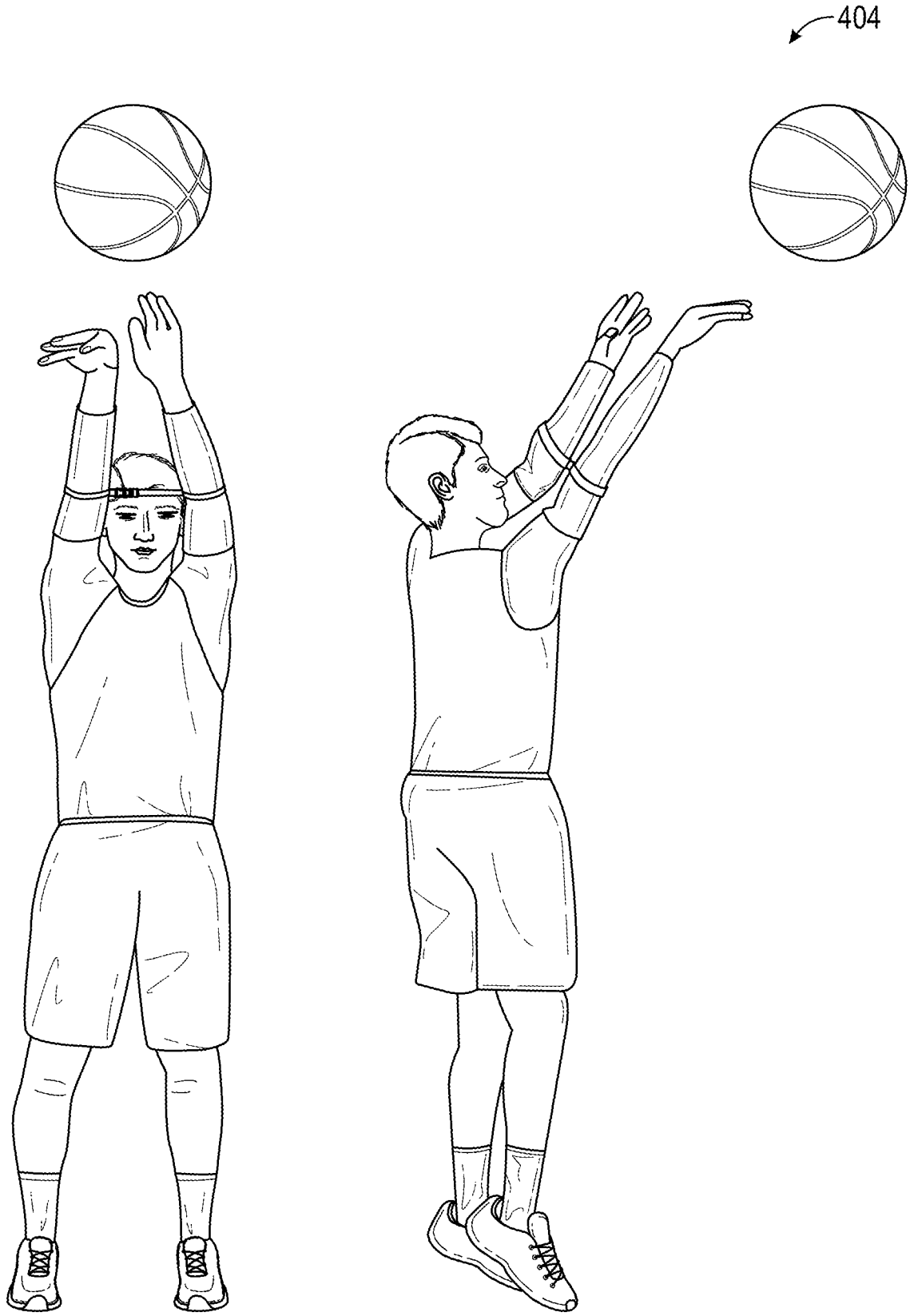

FIGS. 4A-4C illustrate example scenarios in which a person utilizes the training apparatus 200 of FIG. 2 and executes example motions for shooting a basketball. In the illustrated examples, a person is equipped with the training apparatus 200 of FIG. 2 and executes the three-step shooting motion, as described with respect to FIGS. 1A-1C. In the illustrated examples, the training apparatus 200 is equipped on the person in a manner as described with respect to FIG. 3. Effects of the training apparatus 200 will be described with reference to FIGS. 4A to 4C. FIGS.

Figure 5:
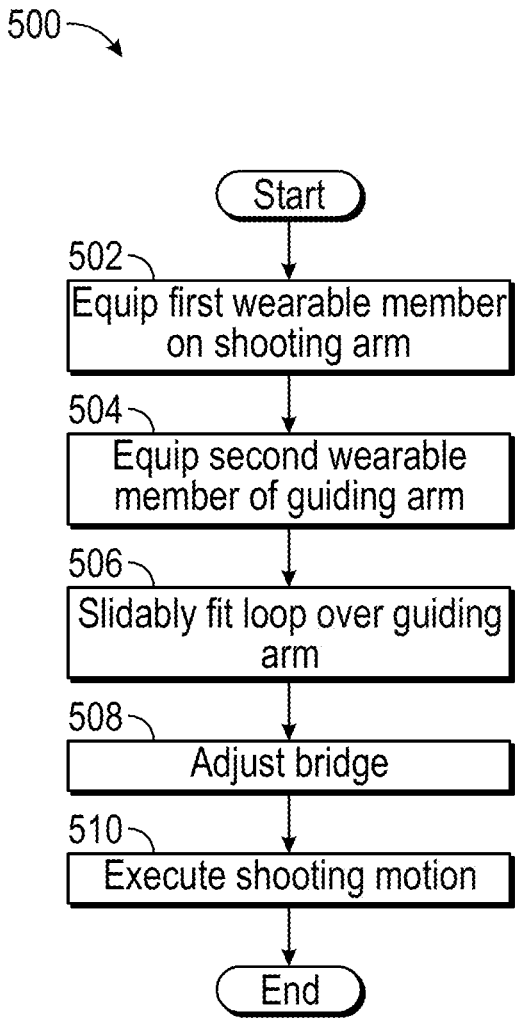
FIG. 5 illustrates a flowchart of a method for shooting a basketball using the training apparatus of FIG. 2

FIG. 5 illustrates a flowchart of a method for shooting a basketball using the training apparatus 200 of FIG. 2

At block 502, the first wearable member 210 is equipped on the shooting arm.

At block 504, the second wearable member 240 is equipped on the guiding arm.

At block 506, the loop 230 is slidably fitted over the guiding arm. The loop 230 is preferably positioned on the upper arm proximate to the elbow.

At block 508, the length of the bridge 220 is adjusted using the first adjustable element 225. If the bridge 220 is disconnected, it may be connected at this block, however, it should be appreciated that the bridge 220 may be connected at any point in time prior to this block.

At block 510, a user executes the shooting motion, preferably, the shooting motion as described with respect to FIGS. 1A-1C and 4A-4C. This block will be described in detail with respect to FIGS. 4A-4C.

FIG. 4A illustrates a first posture 400 of the three-step shooting motion. The first posture 400 is the same or substantially the same as that of FIG. 1A. Therefore, certain details of the FIG. 4A will not be described for sake of brevity. In the illustrated example, the bridge 220 operates as a feedback for ensuring that the person maintains parallel or substantially parallel upper arms throughout the motion. For example, if the person positions the upper arms such that they extend beyond the norm in which the upper arms are parallel or substantially parallel to each other, the person may experience increased elastic force exerted on the bridge 220, which contracts the upper arms. On the other hand, if the person positions the upper arms such that they contract beyond the norm, the person no longer experiences the tension felt on the upper arms when the upper arms were parallel or substantially parallel to each other. Using these indications, the person may maintain parallel or substantially parallel upper arms throughout execution of the shooting motion. Further, as discussed above, during execution of the three-step shooting motion, it is important to maintain the elbows connected in front of the torso. To promote this strategy, the bridge 220 discourages the player from positioning his/her upper arms from moving towards or behind his/her torso via elastic force exerted thereon.

FIG. 4B illustrates a second posture 402 of the three-step shooting motion. The second posture 400 is the same or substantially the same as that of FIG. 1B. Therefore, certain details of the FIG. 4*b* will not be described for sake of brevity. In the illustrated example, the bridge 220 continues to provide feedback as the user transitions to the second posture 402. The bridge 220 further ensures that the user's upper arms remain in front of his/her torso.

FIG. 4C illustrates a third posture 404 of the three-step shooting motion. The third posture 404 is the same or substantially the same as that of FIG. 1C. Therefore, certain details of the FIG. 4C will not be described for sake of brevity. In the illustrated example, the bridge 220 continues to provide feedback as the user transitions to the third posture 404. In certain embodiments, as the ball releases, the shooting arm may stretch further from the torso than the guide arm, thereby causing a positional offset between the shooting arm and the guide arm. However, since the bridge 220 is formed of a flexibly material and since the loop 230 is slidably connected to the guide arm, discomfort due to the positional offset may be mitigated by these features.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". As used here, the terms "module" and "unit" refer to hardware with circuitry to provide communication, control and/or monitoring capabilities, often in conjunction with sensors. "Modules" and "units" may also include firmware that executes on the circuitry. The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment (s) without substantially departing from the spirit and principles of the techniques described herein. All modifications are intended to be included herein within the scope of this disclosure and protected by the following claims.

What is claimed is:

1. A training apparatus for assisting a person shooting a basketball, the training apparatus comprising:

a shooting sleeve having a cylindrical body and extending along a longitudinal axis, the shooting sleeve configured to be equipped on a first arm of the person and comprising a reinforced connection loop located in one half of the shooting sleeve and proximate to a center of the shooting sleeve, wherein:

the reinforced connection loop has a first thickness of an elastic material, the shooting sleeve defines a first opening at a first end having a first width independent of being equipped on the first arm of the person, the shooting sleeve defines a second opening at a second, opposite end having a second, different width independent of being equipped on the first arm of the person, and a portion of the shooting sleeve spaced apart from the reinforced connection loop along the longitudinal axis has a second thickness of the elastic material, the second thickness being less than the first thickness;

a loop configured to slidably fit on a second arm of the person; and a bridge configured to directly connect the reinforced connection loop of the shooting sleeve and the loop, the bridge including:

a first strap of the elastic material, the first strap having a first end connected to the reinforced connection loop and a second end connected to a strap adjuster configured to adjust a length of the bridge, and a second strap of the elastic material, the second strap having a first end connected to the strap adjuster and a second end connected to the loop.

2. The training apparatus of claim 1, wherein the bridge further includes a side release buckle.

3. The training apparatus of claim 2, wherein the side release buckle is positioned on the bridge such that the side release buckle is closer to the shooting sleeve than the loop.

4. The training apparatus of claim 2, wherein the side release buckle is integrated with the adjustable element.

5. The training apparatus of claim 1, wherein the strap adjuster is positioned on the bridge such that the strap adjuster is closer to the shooting sleeve than the loop.

6. The training apparatus of claim 1, wherein the loop is formed of an elastic material.

7. The training apparatus of claim 1, wherein the strap adjuster comprises:

a first clip integrated with the strap adjuster; and a second clip configured to receive the first clip.

8. The training apparatus of claim 1, further comprising a second wearable member configured to be equipped on the second arm of the person, wherein the loop is further configured to be slidably fitted on the second arm of the person over the second wearable member.

9. The training apparatus of claim 1, wherein the shooting sleeve is configured to cover the first arm of the person from a wrist to an upper arm.

10. The training apparatus of claim 9, wherein, when the shooting sleeve is fully equipped, the reinforced connection loop is positioned over the upper arm proximate to an elbow.

11. A method of assisting a person shooting a basketball, the method comprising:

equipping a shooting sleeve on a first arm of the person, the shooting sleeve having a cylindrical body, extending along a longitudinal axis, and comprising a reinforced connection loop having a first thickness of an elastic material and located in one half of the shooting sleeve and proximate to a center of the shooting sleeve, the shooting sleeve defining a first opening at a first end having a first width prior to the shooting sleeve being equipped on the first arm of the person and a second opening at a second, opposite end having a second, different width prior to the shooting sleeve being equipped on the first arm of the person, wherein a portion of the shooting sleeve spaced apart from the reinforced connection loop along the longitudinal axis has a second thickness of the elastic material, the second thickness being less than the first thickness;

slidably fitting a loop on a second arm of the person, wherein the loop is directly connected to reinforced connection loop of the shooting sleeve via a bridge including a first strap of the elastic material and a second strap of the elastic material, the first strap having a first end connected to the reinforced connection loop and a second end connected to a strap adjuster, and the second strap having a first end connected to the strap adjuster and a second end connected to the loop;

adjusting, via the strap adjuster, a length of the bridge; and during execution of a three-step basketball shooting motion, using tension applied on the bridge to adjust positions of the first arm and the second arm.

12. A basketball shooting training apparatus comprising:

a shooting sleeve having a cylindrical body and extending along a longitudinal axis, the shooting sleeve configured to be equipped on a first arm of a person and comprising a connection loop located in one half of the shooting sleeve and proximate to a center of the shooting sleeve, wherein:

the connection loop has a first thickness of an elastic material, a first portion of the shooting sleeve spaced apart from the connection loop along the longitudinal axis has a second thickness of the elastic material, the second thickness being different from the first thickness, a second, different portion of the shooting sleeve spaced apart from the connection loop along the longitudinal axis and spaced apart from the first portion along the longitudinal axis has a third thickness of the elastic material, the third thickness being different from the first thickness, the shooting sleeve defines a first opening at a first end having a first width, and the shooting sleeve defines a second opening at a second, opposite end having a second, different width;

a loop configured to slidably fit on a second arm of the person; and a bridge configured to directly connect the connection loop of the shooting sleeve and the loop, the bridge including:

a first strap of the elastic material, the first strap having a first end connected to the reinforced connection loop and a second end connected to a strap adjuster configured to adjust a length of the bridge, and a second strap of the elastic material, the second strap having a first end connected to the strap adjuster and a second end connected to the loop.

* * * * *